US010181626B2

(12) United States Patent
Kim et al.

(10) Patent No.: US 10,181,626 B2
(45) Date of Patent: Jan. 15, 2019

(54) RESONATOR AND FILTER INCLUDING THE SAME

(71) Applicant: INNERTRON, INC., Incheon (KR)

(72) Inventors: Hyo Chul Kim, Bucheon-si (KR); Tae Jin Jeong, Incheon (KR)

(73) Assignee: INNERTRON, INC., Incheon (KR)

( * ) Notice: Subject to any disclaimer, the term of this patent is extended or adjusted under 35 U.S.C. 154(b) by 0 days.

(21) Appl. No.: 15/278,650

(22) Filed: Sep. 28, 2016

(65) Prior Publication Data

US 2018/0076498 A1 Mar. 15, 2018

(30) Foreign Application Priority Data

Sep. 9, 2016 (KR) ..... 10-2016-0116136

(51) Int. Cl.
*H01P 1/208* (2006.01)
*H01P 3/10* (2006.01)

(52) U.S. Cl.
CPC ..... *H01P 1/2084* (2013.01); *H01P 3/10* (2013.01)

(58) Field of Classification Search
CPC ..... H01P 1/208; H01P 3/10; H01P 1/2084
USPC ..... 333/207, 209, 227
See application file for complete search history.

(56) References Cited

U.S. PATENT DOCUMENTS 6,366,184 B1 * 4/2002 Ohtonen ..... H01P 1/2053 333/202
2015/0042419 A1 * 2/2015 Cho ..... H01P 1/2082 333/204
2015/0280302 A1 * 10/2015 Seo ..... H01P 1/2084 333/209
2016/0329619 A1 11/2016 Gunther et al.

FOREIGN PATENT DOCUMENTS

DE 10 2015 006 070 B3 6/2016
EP 2 573 939 A1 3/2013

OTHER PUBLICATIONS

Notice to Submit Response issued in the KR Patent Office in KR 10-2016-0116136 dated Oct. 16, 2017.
Notice of Reasons for Refusal issued in the JP Patent Office in JP 2016-188586 dated Oct. 12, 2017.

* cited by examiner

*Primary Examiner* — Rakesh Patel
(74) *Attorney, Agent, or Firm* — Sughrue Mion, PLLC

(57) ABSTRACT

A filter including a resonator formed of metal and including a first through hole in one direction, and a transmission line penetrating through the first through hole, wherein the transmission line is spaced apart from the first through hole.

5 Claims, 6 Drawing Sheets

RESONATOR AND FILTER INCLUDING THE SAME

CROSS REFERENCE TO RELATED APPLICATIONS

This application claims priority from Korean Patent Application No. 10-2016-0116136, filed on Sep. 9, 2016, in the Korean Intellectual Property Office, the contents of which are incorporated herein by reference in their entireties.

BACKGROUND

1. Field

The inventive concept relates to a resonator and a filter including the same, and more particularly, to a resonator including a through hole through which a transmission line may penetrate, in which the transmission line is spaced apart from the through hole, and a filter including the resonator.

2. Description of the Related Art

A communication system uses various filters. The filters, through which only signals in a specific frequency band pass, may be divided into a low pass filter (LPF), a band pass filter (BPF), a high pass filter (HPF), and a band stop filter (BSF) according to a frequency band to be filtered.

Furthermore, the filters may be divided into an inductive-capacitive (LC) filter, a transmission line filter, a cavity filter, a dielectric resonator (DR) filter, a ceramic filter, a coaxial filter, a waveguide filter, and a surface acoustic wave (SAW) filter according to a method of manufacturing a filter and a device for the filter.

A resonator having a high Q-factor is required to realize narrow-band characteristics and superior cut-off characteristics on a filter at the same time. In this case, the resonator may be implemented mainly as a printed circuit board (PCB), a dielectric resonator, or a monoblock.

SUMMARY

According to an aspect of the inventive concept, a resonator including a through hole through which a transmission line may penetrate, in which the transmission line is spaced apart from the through hole, and a filter including the resonator.

According to an aspect of the inventive concept, A filter comprising: a resonator formed of metal and comprising a first through hole in one direction; and a transmission line penetrating through the first through hole, wherein the transmission line is spaced apart from the first through hole.

In an embodiment, the filter may comprises a plurality of resonators formed of metal and respectively comprising the first through hole in one direction, and the transmission line penetrates through the first through hole of each of the plurality of resonators.

In an embodiment, the filter may be a band stop filter (BSF).

In an embodiment, the first through hole may be formed in a signal transmission direction in the filter.

In an embodiment, the filter may comprises a gap holding member arranged between the first through hole of the resonator and the transmission line.

In an embodiment, the filter may comprises a housing storing the plurality of resonators in a cavity divided into a plurality of areas.

In an embodiment, each of the plurality of resonators may comprises a second through hole formed in a direction that is different from the direction of the first through hole, wherein a tuning unit is inserted in the second through hole.

In an embodiment, the second through hole may be perpendicular to the first through hole but does not cross the first through hole.

In an embodiment, the second through hole may be perpendicular to the first through hole and crosses the first through hole, and In an embodiment, a lower end of the tuning unit may be located in an upper portion of the first through hole when the tuning unit is inserted in the second through hole to the maximum.

According to an aspect of the inventive concept, a resonator comprising: a body formed of metal; and a through hole formed in one direction of the body and through which a transmission line penetrates, wherein the transmission line is spaced apart from the through hole.

A resonator and a filter including the same may have broad band-stop characteristics by using a resonator including a through hole through which a transmission line may penetrate, in which the transmission line is spaced apart from the through hole.

Furthermore, since the resonator and the filter including the same have the transmission line penetrating through the through hole of the resonator, a separate space for the transmission line is unnecessary, and thus, the resonator may be miniaturized.

Furthermore, stable filter characteristics may be provided by additionally arranging a gap holding member between the through hole of the resonator and the transmission line and by preventing contact between the transmission line and the resonator.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
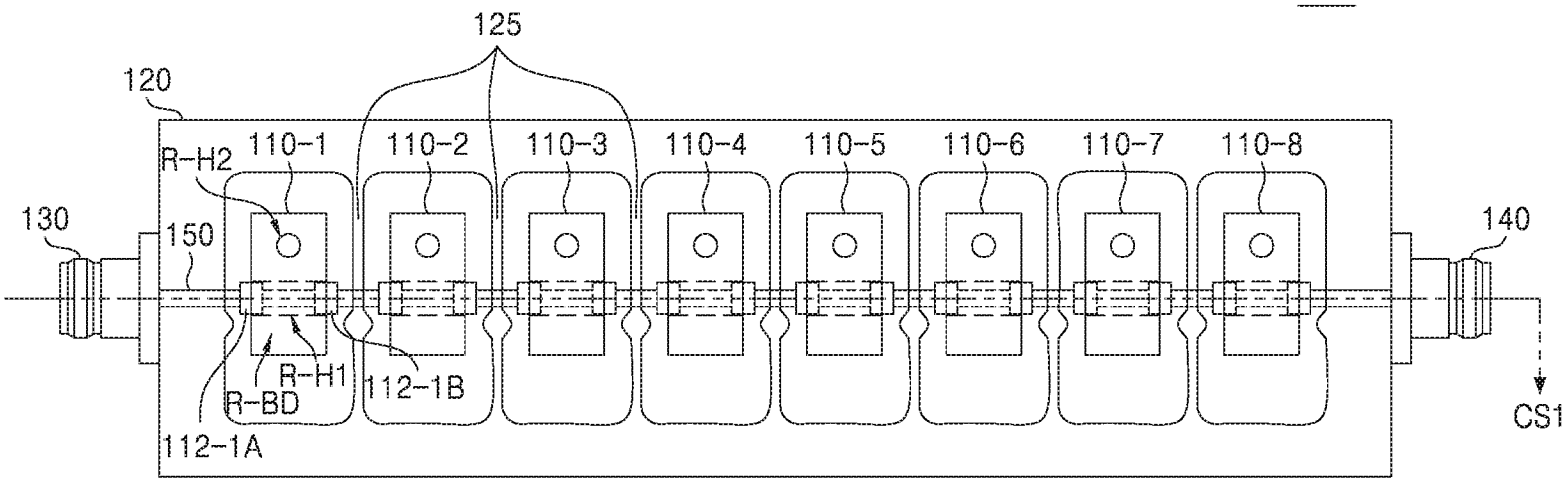
FIG. 1 is a plan view of a filter according to an embodiment of the inventive concept.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of", when preceding a list of elements, modify the entire list of elements and do not modify the individual elements of the list.

In the description of the present disclosure, certain detailed explanations of the related art are omitted when it is deemed that they may unnecessarily obscure the essence of the inventive concept. While the terms including an ordinal number, such as "first", "second", etc., may be used to describe various components, such components are not be limited by theses terms. The terms first and second should not be used to attach any order of importance but are used to distinguish one element from another element.

Throughout the specification, it will be understood that when a unit is referred to as being "connected" to another element, it may be "directly connected" to the other element or "electrically connected" to the other element in a state in which intervening elements are present.

In addition, terms such as " . . . unit", " . . . module", or the like refer to units that perform at least one function or operation, and the units may be implemented as hardware or software or as a combination of hardware and software.

Furthermore, components of the specification are divided in accordance with a main function of each component. For example, combining two or more elements are in a single component, as needed, or may be one component configuration is subdivided into two or more components. Each of the components may further perform some or all of the functions of other components as well as its main functions, and some of the main functions may also be performed by other components.

Hereinafter, embodiments of the present invention will be described in detail with reference to the accompanying drawings.

Figure 2:
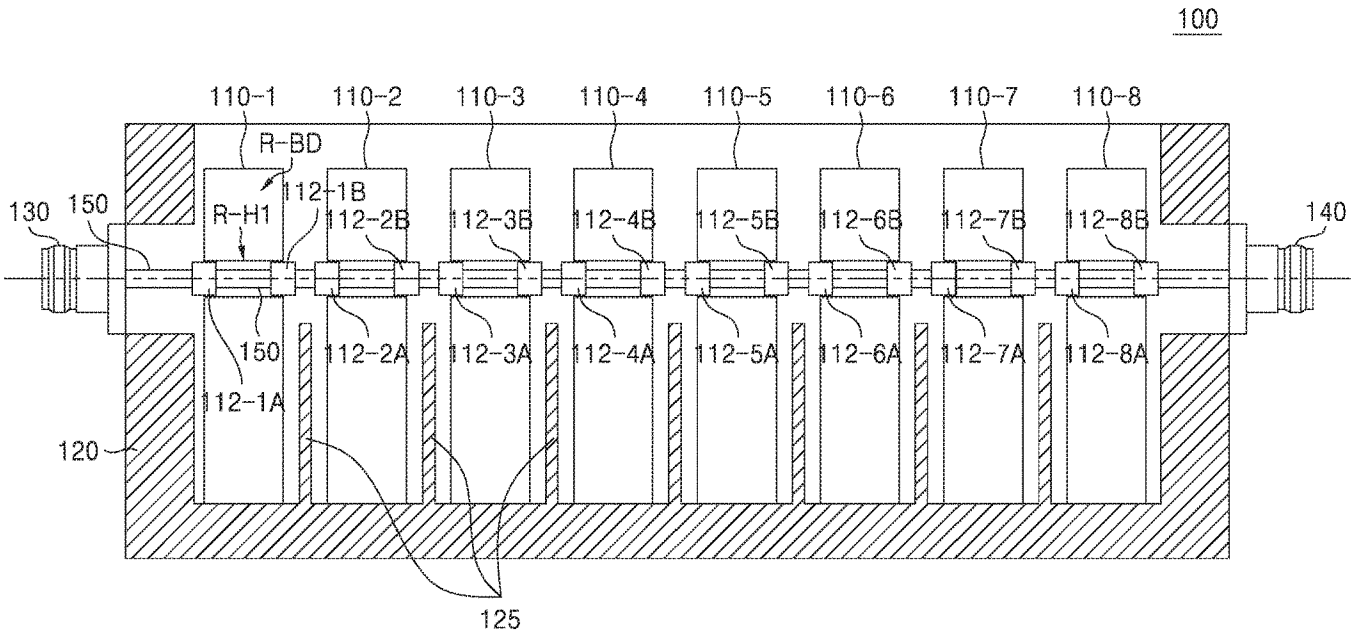
FIG. 2 is a cross-sectional view taken along a cut surface CS1 of FIG. 1.

FIG. 1 is a plan view of a filter according to an embodiment of the inventive concept. FIG. 2 is a cross-sectional view taken along a cut surface CS1 of FIG. 1.

Referring to FIGS. 1 and 2, a filter 100 may include a plurality of resonators 110-1 to 110-8, a housing 120, a plurality of barrier ribs 125, a first connector 130, a second connector 140, and a transmission line 150.

For convenience of description, FIG. 1 illustrates the filter 100 as a reference. However, the filter 100 may be replaced by or deformed into various communication components such as a duplexer or a multiplexer which may include a plurality of resonators, according to an embodiment.

The plurality of resonators 110-1 to 110-8 are arranged on a signal transmission path of the filter 100, and may be coupled into and stored in the housing 120.

For example, the plurality of resonators 110-1 to 110-8 may be coupled into the housing 120 through a screw connection.

According to an embodiment, a lower surface of the housing 120 may be realized by a separate substrate, wherein the plurality of resonators 110-1 to 110-8 may be coupled to the substrate and stored in the housing 120.

For example, the plurality of resonators 110-1 to 110-8 may be coupled to a separate substrate through a plating process.

A plurality of cavities divided with the plurality of barrier ribs 125 may be formed in the housing 120, and the plurality of resonators 110-1 to 110-8 may be stored in the cavities. An arrangement of the barrier ribs 125 may vary and a signal transmission path in the housing 120 may change according to the arrangement of the barrier ribs 125.

The housing 120 is shown as a rectangular parallelepiped, however, the inventive concept is not limited thereto and technical scope of the inventive concept should not be construed as being limited to a shape of the housing 120.

According to an embodiment, an outer surface or inner surface of the housing 120 may be plated with a conductive material (for example, silver (Ag) or copper (Cu)).

The first connector 130 may be formed on one side of the housing 120. The first connector 130 may connect the filter 100 with an external communication component on one side of the filter 100. According to an embodiment, when the first connector 130 is connected to an antenna external to filter 100, the first connector 130 may transmit a signal received from the antenna to the filter 100.

The second connector 140 may be formed on the other side of the housing 120. The second connector 140 may connect the filter 100 with an external communication component on the other side of the filter 100.

The transmission line 150 may transmit a signal input through a connector (for example, the first connector 130) on one side of the filter 100 to a connector (for example, the second connector 140) on the other side of the filter 100.

Each of the plurality of resonators 110-1 to 110-8 may include a body R-BD formed of metal, a first through hole R-H1 formed in one direction of the body R-BD, and a second through hole R-H2 formed in the other direction of the body R-BD.

According to an embodiment, the body R-BD of each of the plurality of resonators 110-1 to 110-8 may include a dielectric material. In this case, at least one of an outer surface of each of the plurality of resonators 110-1 to 110-8, the first through hole R-H1, and the second through hole R-H2 may include a plating layer including a conductive material (for example, Ag or Cu).

Here, the filter 100 may be operated in a transverse electromagnetic (TEM) mode.

The transmission line 150 may penetrate through the first through hole R-H1 of each of the plurality of resonators 110-1 to 110-8, in which the transmission line 150 may be spaced apart from the first through hole R-H1 of each of the plurality of resonators 110-1 to 110-8.

According to an embodiment, the filter 100 may further include gap holding members 112-1A to 112-8A and 112-1B to 112-8B to maintain a stable distance between the transmission line 150 and the first through hole R-H1 of each of the plurality of resonators 110-1 to 110-8. For example, the gap holding members 112-1A to 112-8A and 112-1B to 112-8B may include a dielectric material (for example, Teflon).

According to another embodiment, when a height of the barrier ribs 125 extends, two of the gap holding members (for example, 112-1A and 112-1B) corresponding to one of the resonators (for example, 110-1) may be fixed by the barrier ribs 125.

According to another embodiment, two of the gap holding members (for example, 112-1A and 112-1B) corresponding to one of the resonators (for example, 110-1) may be a single structure or may not be included in the filter 100. When the gap holding members 112-1A to 112-8A and 112-1B to 112-8B are not included in the filter 100, a space between the transmission line 150 and the first through hole R-H1 may be an air-gap. The structure of the filter 100 of FIGS. 1 and 2 is not limited thereto and the resonators 110-1 to 110-8, the barrier ribs 125, and the gap holding members 112-1A to 112-8A and 112-1B to 112-8B may have various structures and numbers.

For example, a cut end face in a direction of each of the resonators 110-1 to 110-8 may have any one of a circular shape, an oval shape, and a polygonal shape, and a structure of each of the plurality of resonators 110-1 to 110-8 of FIGS. 1 and 2 will be described more fully with reference to FIG. 3.

Figure 3:
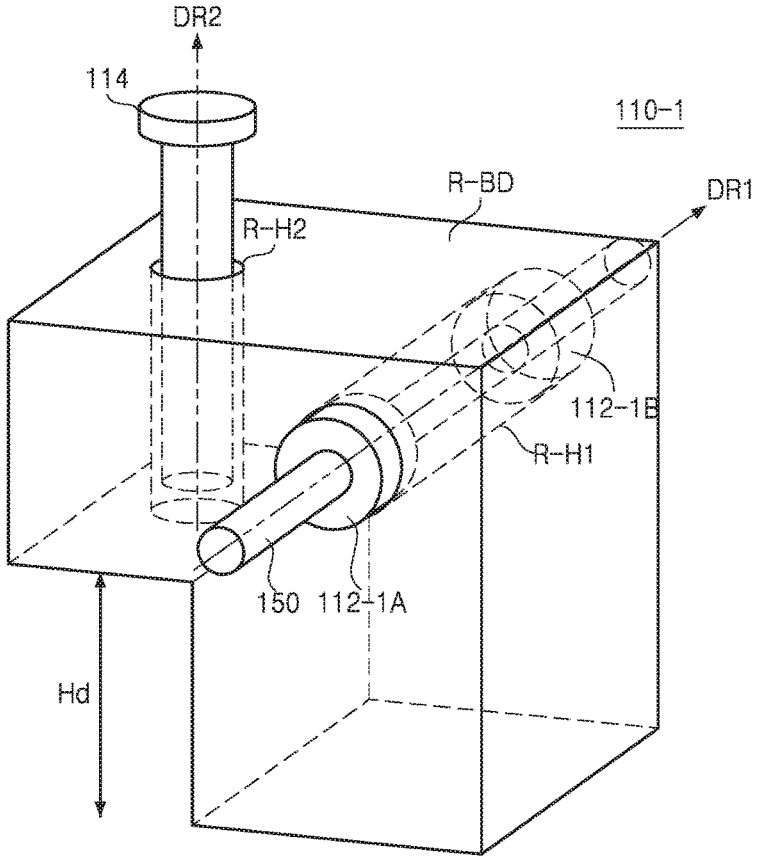
FIG. 3 is an enlarged perspective view of any one of a plurality of resonators of FIG. 1.

FIG. 3 is an enlarged perspective view of any one of the plurality of resonators of FIG. 1.

Referring to FIGS. 1 to 3, any one resonator (for example, a first resonator 110-1) of the plurality of resonators 110-1 to 110-8 of FIG. 1 may include the body R-BD formed of metal, the first through hole R-H1 formed in one direction DR1 of the body R-BD, and the second through hole R-H2 formed in the other direction DR2 of the body R-BD.

According to an embodiment, a body R-BD of one of the resonators (for example, the first resonator 110-1) may include a dielectric material.

The body R-BD of the first resonator 110-1 of FIG. 3 may have a step Hd between a bottom of an area in which the first through hole R-H1 is formed and a bottom of an area in which the second through hole R-H2 is formed. According to an embodiment, the body R-BD of the first resonator 110-1 may be formed in, but is not limited thereto, a rectangular parallelepiped without the step Hd.

The transmission line 150 may penetrate through the first through hole R-H1, in which the transmission line 150 may be spaced apart from the first through hole R-H1. Here, the direction DR1 of forming the first through hole R-H1 may be the same as a signal transmission direction.

The second through hole R-H2 may be formed in the direction DR2 that is different from the direction of the first through hole R-H1, and a tuning unit 114 for controlling communication characteristics of the filter 100 may be inserted in the second through hole R-H2.

According to an embodiment, the direction DR2 of forming the second through hole R-H2 may be perpendicular to the direction DR1 of forming the first through hole R-H1. In other words, the second through hole R-H2 may be perpendicular to the first through hole R-H1.

According to an embodiment, the second through hole R-H2 may not cross the first through hole R-H1. Since the second through hole R-H2 does not cross the first through hole R-H1, the tuning unit 114 inserted in the second through hole R-H2 and the transmission line 150 penetrating through the first through hole R-H1 may not contact each other.

According to another embodiment, the second through hole R-H2 may cross the first through hole R-H1. A position of the first through hole R-H1 and a length of the tuning unit 114 may be designed in a manner where a lower end of the tuning unit 114 is located in an upper portion of the first through hole R-H1 when the tuning unit 114 is inserted in the second through hole R-H2 to the maximum.

According to an embodiment, the second through hole R-H2 may be away from the center of the body R-BD. Here, a variation of characteristics of the filter 100, in which the characteristics of the filter 100 changes according to a unit length of the tuning unit 114 inserted in the second through hole R-H2, is less than a variation of the the characteristics of the filter 100 when the second through hole R-H2 is formed in the center of the body R-BD, and thus, a fine control of the characteristics of the filter 100 is possible.

Figure 4:
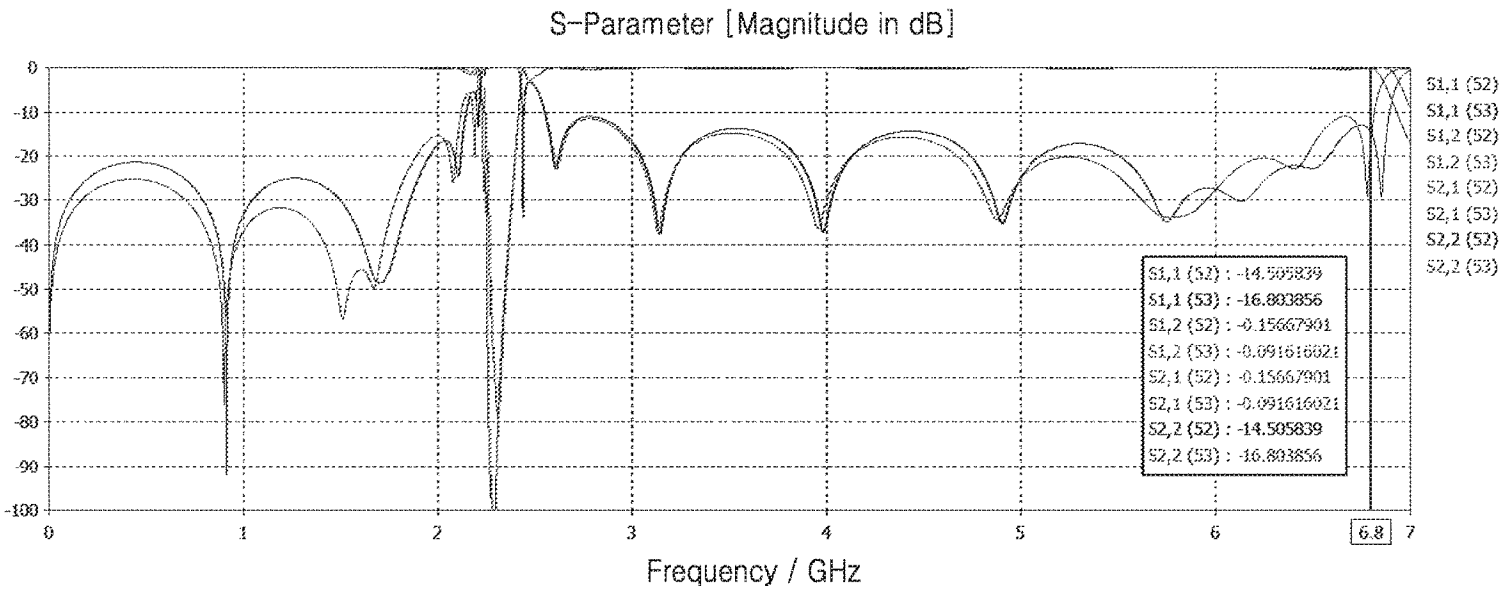
FIG. 4 is a graph illustrating filter characteristics of the filter of FIG. 1.

FIG. 4 is a graph illustrating filter characteristics of the filter of FIG. 1.

Referring to FIGS. 1 to 4, when the transmission line 150 has a structure of penetrating through the first through hole R-H1, in which the transmission line 150 is spaced apart from the first through hole R-H1 of each of the plurality of resonators 110-1 to 110-8, a coupling value may be improved while characteristics of a high frequency harmonic component is prevented from being worse.

In other words, the filter 100 according to an embodiment of the inventive concept may widely design a rejection band like the graph of FIG. 4 by moving the harmonic component to a higher band through the penetration structure.

Figure 5:
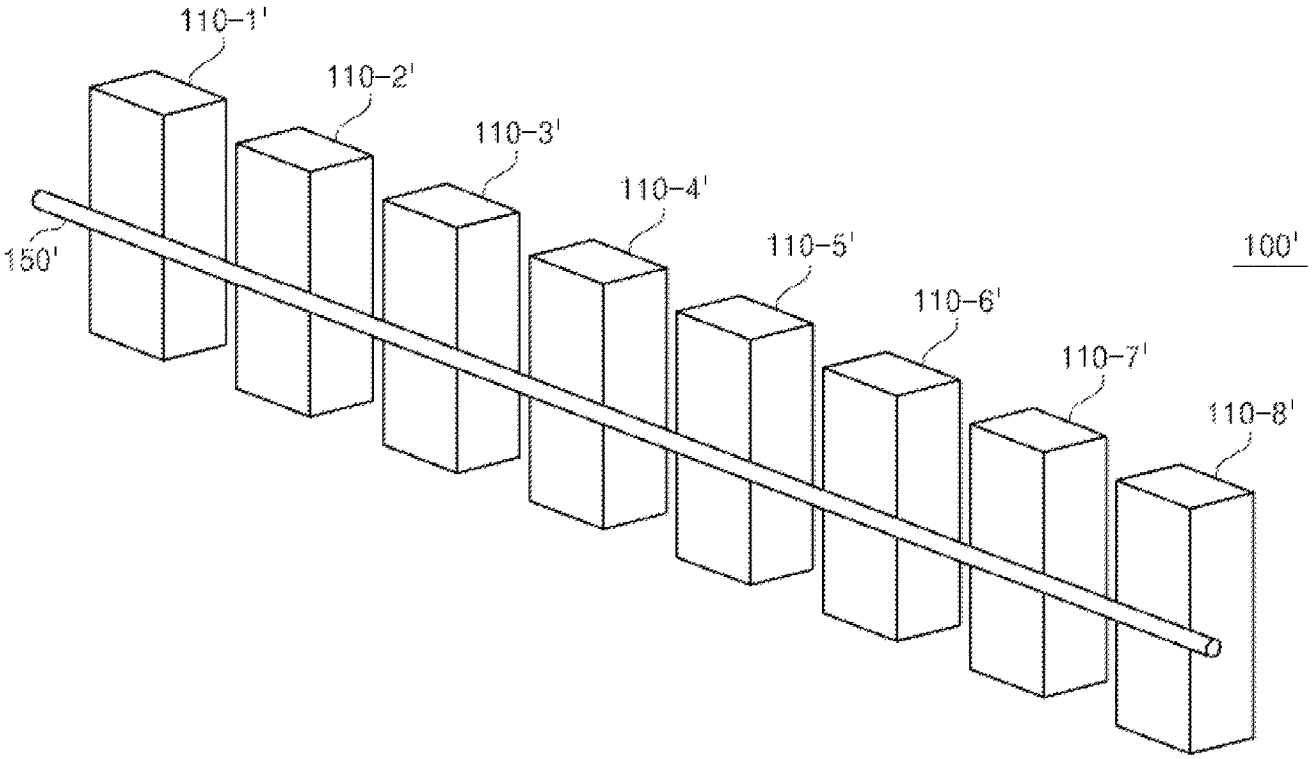
FIG. 5 is a perspective view of a filter according to a comparative example for comparison with the filter of FIG. 1 with reference to filter characteristics.
Figure 6:
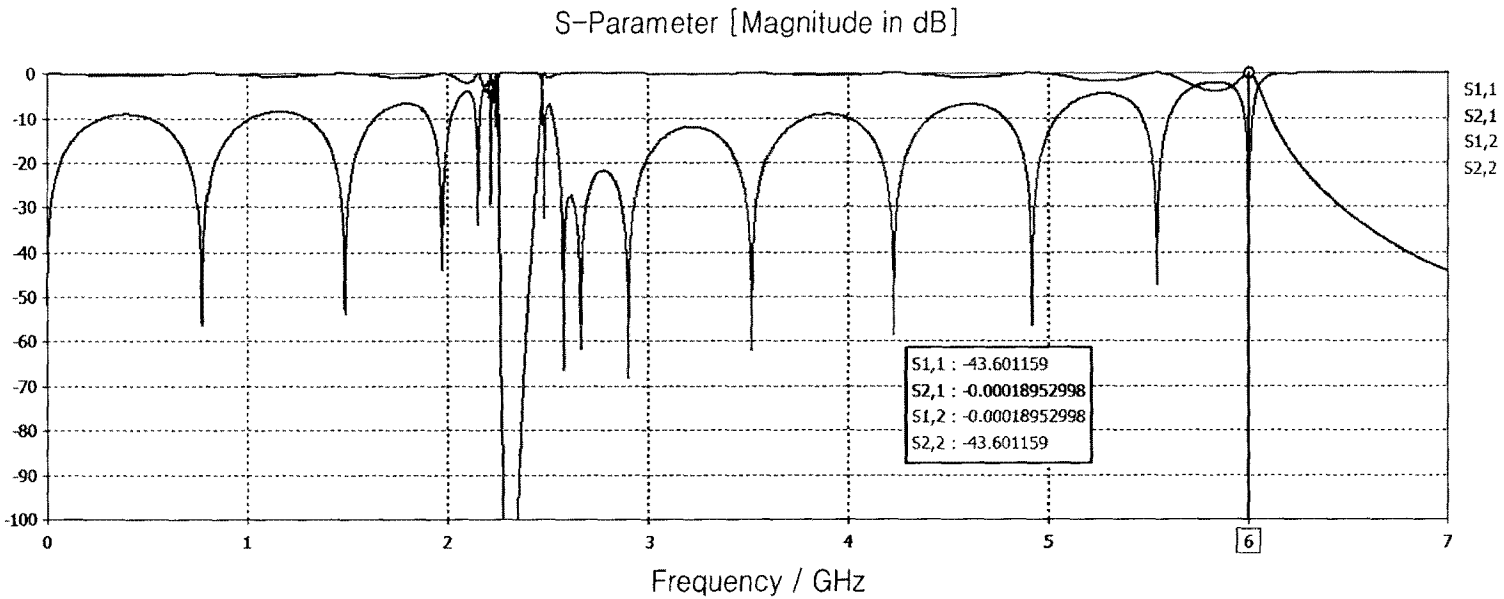
FIG. 6 is a graph illustrating filter characteristics of the filter of FIG. 5.

FIG. 5 is a perspective view of a filter according to a comparative example for comparison with the filter of FIG. 1 with reference to filter characteristics. FIG. 6 is a graph illustrating filter characteristics of the filter of FIG. 5.

Referring to FIG. 5, in a filter 100' according to the comparative example, components except for a plurality of resonators 110-1' to 110-8' and a transmission line 150' are omitted for comparison with the filter of FIG. 1.

Unlike the transmission line 150 of the filter 100 of FIG. 1, the transmission line 150' of the filter 100' does not penetrate through the plurality of resonators 110-1' to 110-8', and may be spaced apart from the plurality of resonators 110-1' to 110-8' at a predetermined interval.

Referring to FIG. 6, a structure of the filter 100' may have a sharpened shape like the graph of FIG. 6 because the rejection band is narrow as the harmonic component moves to a relatively low band.

In other words, the filter 100 according to an embodiment of the inventive concept may have the rejection band designed in a broad band and does not require a separate space for the transmission line 150, and thus, may be smaller than the filter 100' of FIG. 5.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A filter comprising:

a plurality of resonators formed of metal and comprising a plurality of first through holes, respectively, in one direction; and a transmission line penetrating through the plurality of first through holes, wherein the transmission line is spaced apart from the plurality of first through holes, wherein the plurality of resonators comprise a plurality of second through holes, respectively, the plurality of second through holes being formed in a direction that is different from the direction of the plurality of first through holes, wherein a plurality of tuning units are inserted in each of the plurality of second through holes, respectively, wherein each of the plurality of second through holes is perpendicular to each of the plurality of first through holes and crosses one of the plurality of first through holes, and wherein a lower end of each of the plurality of the tuning units is located in an upper portion of each of the plurality of first through holes when each of the plurality of tuning units is maximally inserted in each of the plurality of second through holes.

2. The filter of claim 1, wherein the filter further comprises a housing storing the plurality of resonators in a cavity divided into a plurality of areas.

3. The filter of claim 1, wherein the filter is a band stop filter (BSF).

4. The filter of claim 1, wherein each of the plurality of first through holes is formed in a signal transmission direction in the filter.

5. The filter of claim 1, further comprising a plurality of gap holding members arranged between the plurality of first through holes and the transmission line.

* * * * *